US010006290B2

(12) United States Patent
Houst et al.

(10) Patent No.: US 10,006,290 B2
(45) Date of Patent: Jun. 26, 2018

(54) FUNCTIONALLY ASYMMETRIC TWO-SIDED TURBOCHARGER WHEEL AND DIFFUSER

(71) Applicant: HONEYWELL INTERNATIONAL INC., Morristown, NJ (US)

(72) Inventors: Vit Houst, Sestajovice (CZ); Daniel Turecek, Ostopovice (CZ); Vaclav Kares, Strakonice (CZ); Milan Nejedly, Brno (CZ); Michal Mokos, Prievidza (SK); Hua Chen, Shanghai (CN); Annie Li, Shanghai (CN); Michael Zhao, Shanghai (CN); Wei Dai, Shanghai (CN); Jose Luis Lazaro Bercianos, Brno (CZ)

(73) Assignee: Honeywell International Inc., Morris Plains, NJ (US)

( * ) Notice: Subject to any disclaimer, the term of this patent is extended or adjusted under 35 U.S.C. 154(b) by 1329 days.

(21) Appl. No.: 14/011,698

(22) Filed: Aug. 27, 2013

(65) Prior Publication Data

US 2015/0063980 A1 Mar. 5, 2015

(51) Int. Cl.
*F01D 5/02* (2006.01)
*F04D 17/10* (2006.01)
(Continued)

(52) U.S. Cl.
CPC ..... *F01D 5/02* (2013.01); *F04D 17/105* (2013.01); *F04D 25/024* (2013.01);
(Continued)

(58) Field of Classification Search
CPC ..... F01D 5/02; F04D 17/105; F04D 25/024; F04D 29/284; F04D 29/441; F05D 2220/40; F05D 2250/73
(Continued)

(56) References Cited

U.S. PATENT DOCUMENTS 4,725,196 A 2/1988 Kaneki et al.
7,014,418 B1 3/2006 Arnold et al.
(Continued)

FOREIGN PATENT DOCUMENTS

EP 0 270 723 A1 6/1988
EP 2 525 101 A2 11/2012
(Continued)

OTHER PUBLICATIONS

EPO, "Communication" including an Extended European Search Report and a Search Opinion, for counterpart European Patent Application No. EP 14180284.3, dated Jan. 21, 2015.
(Continued)

*Primary Examiner* — Mark Laurenzi
*Assistant Examiner* — Paul Thiede
(74) *Attorney, Agent, or Firm* — The Law Office of John A. Griecci

(57) ABSTRACT

A two-sided turbocharger compressor wheel and a housing forming a diffuser for the compressor. A first side and a second side of the compressor wheel are characterized by different values of a trim and of an annulus area. A first side of the diffuser surrounds the first side of the compressor wheel, and a second side of the diffuser surrounds the second side of the compressor wheel. The first and second sides of the diffuser are characterized by different annulus area ratios. The blades of the first and second sides of the compressor wheel are angularly offset from one another. The compressor wheel is configured for greater flow through the side of the compressor wheel that faces away from a related turbine wheel.

21 Claims, 6 Drawing Sheets

(51) Int. Cl.
*F04D 25/02* (2006.01)
*F04D 29/28* (2006.01)
*F04D 29/44* (2006.01)

(52) U.S. Cl.
CPC ..... *F04D 29/284* (2013.01); *F04D 29/441* (2013.01); *F05D 2220/40* (2013.01); *F05D 2250/73* (2013.01)

(58) Field of Classification Search
USPC ..... 415/1, 98
See application file for complete search history.

(56) References Cited

U.S. PATENT DOCUMENTS

| | | | | |
|---|---|---|---|---|
| 8,453,448 | B2 | 6/2013 | Lotterman et al. | |
| 2007/0113551 | A1 | 5/2007 | Arnold et al. | |
| 2010/0319343 | A1 | 12/2010 | Arnold et al. | |
| 2012/0294703 | A1* | 11/2012 | Lei ..... | F04D 17/105 415/1 |
| 2013/0263592 | A1 | 10/2013 | Lotterman et al. | |

FOREIGN PATENT DOCUMENTS

| | | | |
|---|---|---|---|
| JP | H04 209993 | A | 7/1992 |
| WO | WO 00/01935 | A1 | 1/2000 |

OTHER PUBLICATIONS

EPO, "Communication" including an Extended European Search Report and a Search Opinion, for a counterpart European Patent Application No. EP 14180283.5, dated Aug. 20, 2015.

* cited by examiner

FUNCTIONALLY ASYMMETRIC TWO-SIDED TURBOCHARGER WHEEL AND DIFFUSER

The present invention relates to a wheel for a turbocharger, and more particularly, to a two-sided automotive compressor wheel and its related diffuser.

BACKGROUND OF THE INVENTION

Turbocharger compressors are characterized by a range of performance levels over a range of operating conditions. Typically this is graphically depicted on a compressor map, which plots the compressor pressure ratio against the corrected airflow levels for a range of design operating conditions. The compressor map defines a surge line and a choke line, which correspond to the varying extreme operating conditions at which the compressor will experience surge, i.e., at which significant intermittent backflow of air through the compressor will occur, and choke. Typically, compressor designs providing for a wider range of operating conditions prior to experiencing surge and choke are considered preferable.

A factor that can vary airflow levels for a single-sided compressor is the pressure of the inlet air at the compressor inducer. Other factors that can vary airflow levels are the geometry of the compressor wheel and the geometry of the diffuser.

With reference to FIG. 1, a single-sided compressor wheel 11 has two primary components, a hub 13 and a set of blades 15, each blade having a leading edge 17 that defines a compressor inducer at the upstream end of the passage through which the blades rotate, a trailing edge 19 that defines a compressor exducer at the downstream end of the passage through which the blades rotate, a hub edge 21 and a shroud edge 23. The each blade's shroud edge generally conforms to a housing shroud 25 with a small clearance.

Single-sided compressor wheel geometry can be significantly characterized by two parameters, the Trim, and the annulus area, which may be referred to as EI. Between two different single-sided compressor wheels, differences between these parameters (the Trim and/or the EI) will generally lead to single-sided compressors configured for different airflow levels (i.e., greater or lesser levels of airflow) for a given air pressure at the compressor inducer. In other words, the variations change the compressor maps. For example, it is known that larger trim numbers lead to greater flow levels.

The structural Trim of a single-sided compressor wheel is defined as follows:

$$\text{Trim} = \frac{D_{1,S}^2}{D_2^2} \times 100$$

As is seen in the figure, $D_{1,S}$ is the diameter of the shroud edge 23 of the (path of the) blades 15 at the inducer (i.e., where the shroud edge of the blades meets the leading edge 17), and $D_2$ is the diameter of the wheel at the root end of the exducer (i.e., where the hub edge meets the trailing edge 19).

In an alternative aerodynamic approach, the aerodynamic $\text{Trim}_A$ is defined as follows: follows:

$$Trim_A = \frac{D_{1,S}^2}{D_{2,RMS}^2} \times 100$$

-continued where $$D_{2,RMS} = \sqrt{\frac{1}{2} \times (D_2^2 + D_{2,tip}^2)}$$

and $D_{2,tip}$ is the diameter of the shroud edge 23 of the (path of the) blades 15 at the exducer (i.e., where the shroud edge of the blade meets the trailing edge 19). It should be noted that the structural trim and the aerodynamic trim are identical when $D_{2,tip}$ equals $D_2$ (e.g., the trailing edge is parallel to the axis of rotation). Throughout this specification, the term Trim will refer the former of these definitions (the structural trim) unless the aerodynamic $\text{Trim}_A$ is expressly recited.

The annulus area of a single-sided compressor wheel is defined as follows:

$$EI = \frac{\text{wheel outlet annulus area, } E}{\text{wheel inlet annulus area, } I} = \frac{\pi D_2 B_2}{\frac{\pi(D_{1,S}^2 - D_{1,H}^2)}{4}}$$

As is seen in the figure, $D_{1,H}$ is the diameter of the hub edge 21 of the (path of the) blades 15 at the inducer (i.e., where the hub edge meets the leading edge 17), and $B_2$ is the axial width of the blades at the exducer.

Two housing walls, 31 & 33, define a single-sided compressor wheel diffuser 41, which is a passageway downstream of the compressor exducer. More particularly, the diffuser of a single-sided compressor is the radial passage extending from the compressor wheel exducer to a compressor volute 43, which is a spiral shaped air passage. The diffuser can be significantly characterized by the parameter DE, the vaneless diffuser annulus area ratio. For two identical single-sided compressor wheels having a given air pressure at their compressor inducers, variation of this parameter (DE) will generally cause the single-sided compressors to be configured for different airflow levels (i.e., greater or lesser levels of airflow), changing the compressor map.

The vaneless diffuser annulus area ratio of a diffuser for a single-sided compressor wheel is defined as follows:

$$DE = \frac{\text{diffuser outlet annulus area, } D}{\text{wheel outlet annulus area, } E} = \frac{D_3 B_3}{D_2(B_2 + e)}$$

As is seen in the figure, $D_3$ is the diameter of a downstream end 45 (outlet) of the diffuser 41 (i.e., where the airstream in the diffuser passageway enters the volute 43), $B_3$ is the final (e.g., downstream end) axial width of the diffuser, and e is the axial distance between the shroud edges 23 of the blades 15 and the shroud 25 at the exducer (where the shroud edge meets the trailing edge 19, i.e., ($B_2$+e) is the axial width of the passageway through which air flows at the exducer).

For various reasons, it is sometimes preferable to use a two-sided compressor wheel. For example, these wheels might have lower rotational inertia than a single-side wheel with a similar level of performance to the combined sides of the two-sided wheel. Alternatively, it might be preferable to have a lower level of axial load generated by the compressor wheel, as may be the case for two-sided compressor wheels. It is known to have a two-sided compressor having symmetric compressor wheel blades and a symmetric diffuser, each being symmetric across a plane of symmetry normal to a wheel axis of rotation (i.e., the middle plane of the hub backplate).

There exists a need for turbochargers having performance- and cost-efficient two-sided compressors. Preferred embodiments of the present invention satisfy these and other needs, and provide further related advantages.

SUMMARY OF THE INVENTION

In various embodiments, the present invention solves some or all of the needs mentioned above. The turbocharger includes a turbocharger housing and a rotor. The rotor is mounted for axial rotation within the housing, and includes a shaft extending axially between a turbine wheel and a two-sided compressor wheel. The compressor wheel has a plurality of blades, including a first set of compressor blades surrounding a first hub portion and a second set of compressor blades surrounding a second hub portion. The first set of compressor blades define a first inducer plane that is farther from the turbine wheel than a second inducer plane that is defined by the second set of blades. The housing defines a diffuser for the compressor wheel, the diffuser including a first portion surrounding the first set of compressor blades, and a second portion surrounding the second set of compressor blades.

The combination of the plurality of blades and the diffuser are functionally asymmetric, i.e., the blades may be functionally asymmetric, the diffuser may be functionally asymmetric, or both. The functional asymmetry may be configured to produce greater airflow through the first set of compressor blades than through the second set of blades. Advantageously, this leads to a greater flux of air through the first set of blades, which benefits from not having an obstructed access to their related inducer (by a bearing housing and the turbine). Thus the greater airflow (i.e., flux) is passed through the more efficient set of blades. Additionally, initial surge events from one set of blades will not typically coincide with initial surge events of the other set of blades, reducing the deleterious effects of a surge event.

Other features and advantages of the invention will become apparent from the following detailed description of the preferred embodiments, taken with the accompanying drawings, which illustrate, by way of example, the principles of the invention. The detailed description of particular preferred embodiments, as set out below to enable one to build and use an embodiment of the invention, are not intended to limit the enumerated claims, but rather, they are intended to serve as particular examples of the claimed invention.

DETAILED DESCRIPTION OF THE PREFERRED EMBODIMENTS

The invention summarized above and defined by the enumerated claims may be better understood by referring to the following detailed description, which should be read with the accompanying drawings. This detailed description of particular preferred embodiments of the invention, set out below to enable one to build and use particular implementations of the invention, is not intended to limit the enumerated claims, but rather, it is intended to provide particular examples of them.

Typical embodiments of the present invention reside in a motor vehicle equipped with an internal combustion engine and a turbocharger. The turbocharger is equipped with a two-sided compressor wheel characterized by a unique blade and/or diffuser configuration that provides for efficient operation.

First Embodiment

Figure 1:
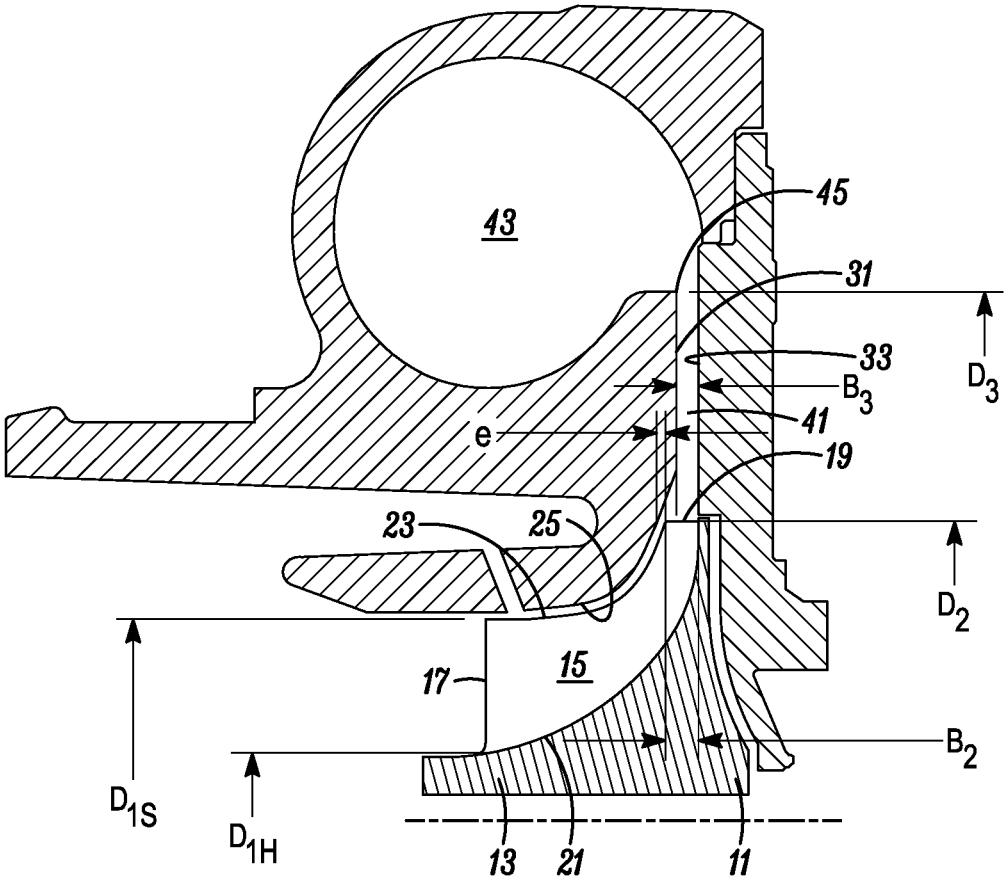
(Prior Art) FIG. 1
FIG. 1 is a cross-sectional meridional partial view of a prior art single sided compressor.
Figure 2:
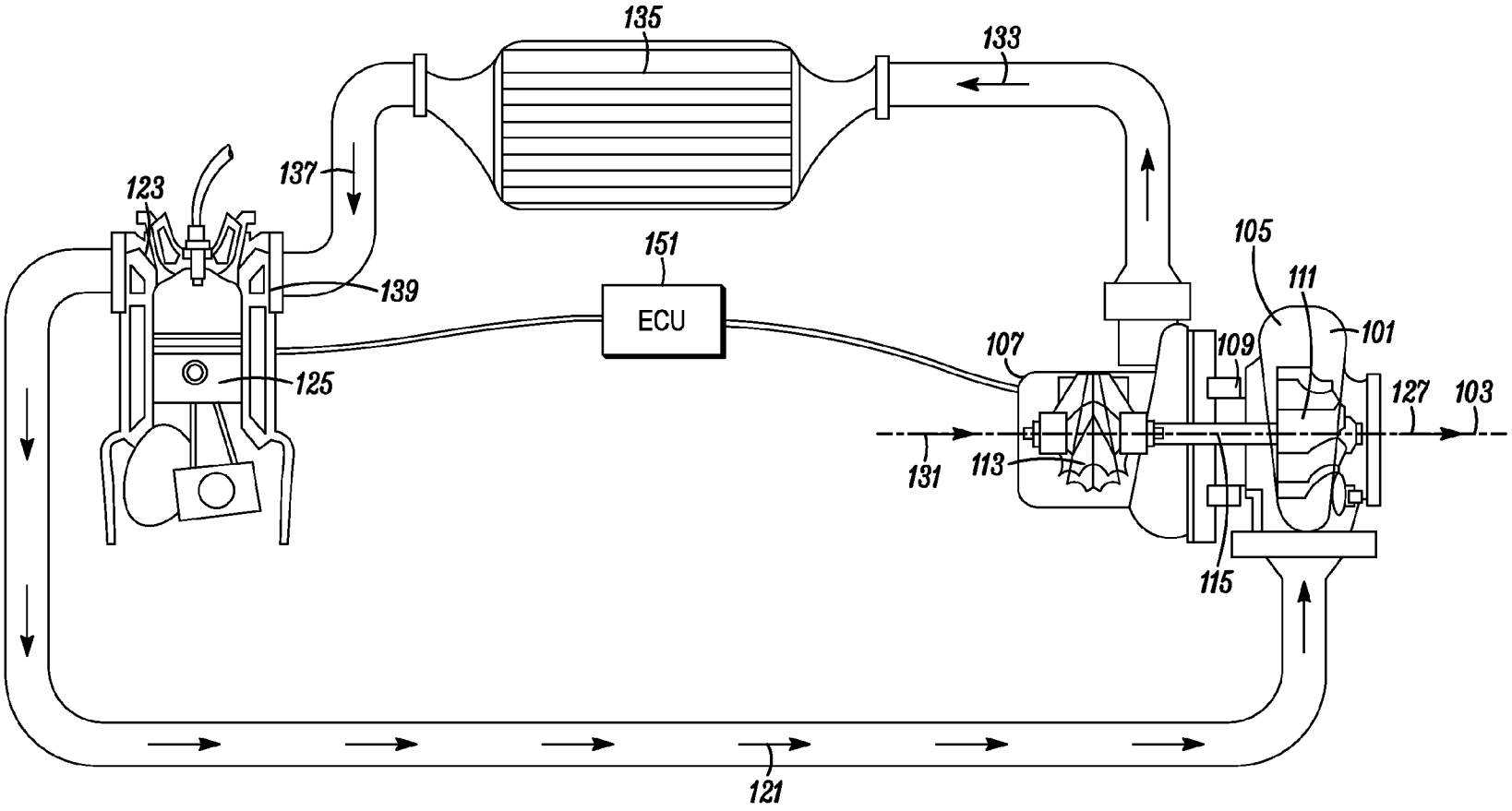
FIG. 2 is a system view of a first embodiment of a turbocharged internal combustion engine under the invention.

With reference to FIG. 2, a typical embodiment of a turbocharger 101 having a turbine and a radial compressor includes a turbocharger housing and a rotor configured to rotate within the turbocharger housing around an axis of rotation 103 during turbocharger operation on thrust bearings and two sets of journal bearings (one for each respective rotor wheel), or alternatively, other similarly supportive bearings. The turbocharger housing includes a turbine housing 105, a compressor housing 107, and a bearing housing 109 (i.e., a center housing that contains the bearings) that connects the turbine housing to the compressor housing. The rotor includes a turbine wheel 111 located substantially within the turbine housing, a two-sided radial compressor wheel 113 located substantially within the compressor housing, and a rotor shaft 115 extending along the axis of rotation, through the bearing housing, to connect the turbine wheel to the compressor wheel.

The turbine housing 105 and turbine wheel 111 form a turbine configured to circumferentially receive a high-pressure and high-temperature exhaust gas stream 121 from an engine, e.g., from an exhaust manifold 123 of an internal combustion engine 125. The turbine wheel (and thus the rotor) is driven in rotation around the axis of rotation 103 by the high-pressure and high-temperature exhaust gas stream, which becomes a lower-pressure and lower-temperature exhaust gas stream 127 and is axially released into an exhaust system (not shown).

The compressor housing 107 and two-sided compressor wheel 113 form a compressor stage. The compressor wheel, being driven in rotation by the exhaust-gas driven turbine wheel 111, is configured to compress axially received input air from both axial sides (e.g., ambient inlet air 131, or already-pressurized air from a previous-stage in a multi-stage compressor) into a pressurized air stream 133 that is ejected circumferentially from the compressor. Due to the compression process, the pressurized air stream is characterized by an increased temperature over that of the input air.

Optionally, the pressurized air stream may be channeled through a convectively cooled charge air cooler 135 configured to dissipate heat from the pressurized air stream, increasing its density. The resulting cooled and pressurized output air stream 137 is channeled into an intake manifold 139 on the internal combustion engine, or alternatively, into a subsequent-stage, in-series compressor. The operation of the system is controlled by an ECU 151 (engine control unit) that connects to the remainder of the system via communication connections.

Two-sided compressor wheels with blades that are symmetric across an axial plane (i.e., a plane normal to the axial direction) have previously been designed. These wheels may be considered a subset of functionally symmetric wheels. For the purposes of this application, it should be understood that a two-sided wheel that is functionally symmetric across an axial plane is a wheel having blades having substantially identical (within manufacturing tolerances) aerodynamic characteristics on the two sides of the wheel, even if the blades on the two sides are offset from one another by a given offset angle around the axis of rotation 103. Moreover, for the purposes of the present application, it should be understood that a compressor having functional asymmetry has two-sided performance producing different compressor maps for opposite sides of a two-sided compressor wheel under the assumption that the conditions (e.g., pressures) gat the inducers are identical.

Typically, this means that the geometric blade parameters are identical on both axial sides of the two-sided wheel. It should be noted that this does not require that the blades have an actual axial plane of symmetry (i.e., a plane normal to the axial direction over which the two sets of blades have planar symmetry). It also does not require that the two sets of blades have rotational symmetry around an axis of rotation, though this might often be true. Rather, such axial functional symmetry requires that the two sides are designed with the same geometric parameters, i.e., that they are designed for, and perform at, all the same aerodynamic performance levels when all other parameters (such as inlet pressure at the inducer) are equal.

A two-sided compressor wheel diffuser that is symmetric across an axial plane (i.e., a plane normal to the axial direction) has previously been designed for a symmetric two-sided compressor wheel. Such a diffuser may be considered a functionally symmetric two-sided compressor wheel diffuser. For the purposes of this application, it should be understood that a two-sided wheel diffuser that is functionally symmetric across an axial plane is a diffuser having substantially identical (within manufacturing tolerances) aerodynamic characteristics on the two sides of the diffuser (with the diffuser being split by a plane through the center of the wheel backplate).

Typically, this means that the diffuser annulus area ratio parameter DE is identical on both axial sides of the diffuser. It should be noted that this presumes a definition of DE that is taken separately for each side of its related two-sided compressor wheel. This functional symmetry requires that the two sides are designed with the same geometric parameters, i.e., that they are designed for the same aerodynamic performance levels when all other parameters are equal.

With reference to FIGS. 2-6, the compressor wheel 113 defines a front, first wheel-side 201 and a back, second wheel-side 221. The first wheel-side includes a first hub portion 203 and a first plurality of blades 205 surrounding the first hub portion. Likewise, the second wheel-side includes a second hub portion 223 and a second plurality of blades 225 surrounding the second hub portion. The first and second hub portions are integral, and thus rotate together.

The first and second wheel-sides 201, 221 respectively define a first inducer 207 at an inducer end of the first plurality of blades 205, a second inducer 227 at an inducer end of the second plurality of blades 225, and an almost planar backplate 209 (flat and having only a small thickness) that is common to and extends between the first and second wheels sides. The backplate defines a center-plane 210 that splits the backplate in two and defines the dividing line between the first and second wheel-sides. The first inducer is farther from the turbine than the second inducer. The first inducer faces away from the turbine, while the second inducer faces toward the turbine.

The ambient inlet air 131 is divided into a first inlet air stream 211 coming into the compressor housing that is directed to the inducer of the first wheel-side 201, and a second inlet air stream 231 coming into the compressor housing that is directed to the inducer of the second wheel-side 221. Thus, the compressor wheel is effectively configured as two single-sided compressor wheels adjoined back to back at the backplate (typically in a unitary body) such that the first and second inducers are located at or relatively close to opposite axial ends of the two-sided compressor wheel. It should be noted that the second inlet air stream turns into the axial direction, and is in part guided by a curved extension 232 of the second hub portion.

A first end of the rotor shaft 115 adjoins and extends directly from the second hub portion 223 in the vicinity of the second inducer 227 of the second wheel-side 221. A second end of the rotor shaft connects to the turbine wheel 111. The first wheel-side 201 of the compressor wheel 113 is thus configured as an external-inducer wheel-side, i.e., the inducer of the first wheel-side faces away from the turbine wheel and the bearing housing. The second wheel-side of the compressor wheel is thus configured as an internal-inducer wheel-side, i.e., the inducer of the second wheel-side faces toward the turbine wheel and the bearing housing. Thus, the first wheel-side inducer may receive air axially without obstruction, while the second wheel-side inducer is axially obstructed by the bearing housing and the turbine wheel, necessitating the turning of the second air stream from a non-axial direction to an axial direction at a location between the compressor wheel and the turbine wheel.

This turning of the airstream may cause a pressure drop in the airflow, leading to differing air pressures at the inlets of the first and second wheel-sides, thereby reducing the efficiency of the second wheel-side of the compressor wheel. Moreover, the overall geometry and structure of the inlet system may include other pressure losses upstream of one or both inlets, causing further differences between the inlet pressures.

Blades

The first plurality of blades 205 is characterized by a first set of parameters, which includes a first trim (i.e., Trim1) and a first annulus area (i.e., EI1). Likewise, the second plurality of blades 225 is characterized by a second set of parameters, which includes a second trim (i.e., Trim2) and a second annulus area (i.e., EI2).

Trim1 and Trim2 may be calculated as follows:

$$\text{Trim1} = \frac{D1_{1,S}^2}{D1_2^2} \times 100$$

$$\text{Trim2} = \frac{D2_{1,S}^2}{D2_2^2} \times 100$$

Figure 4:
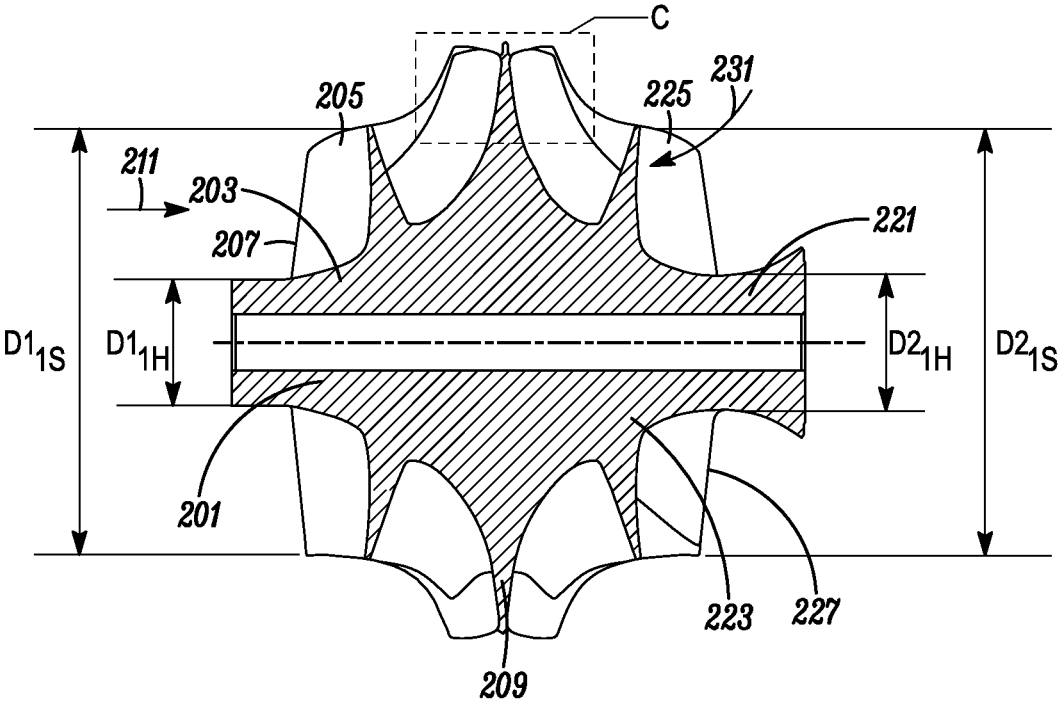
FIG. 4 is a cross-sectional view of the two-sided compressor wheel depicted in FIG. 3.
Figure 5:
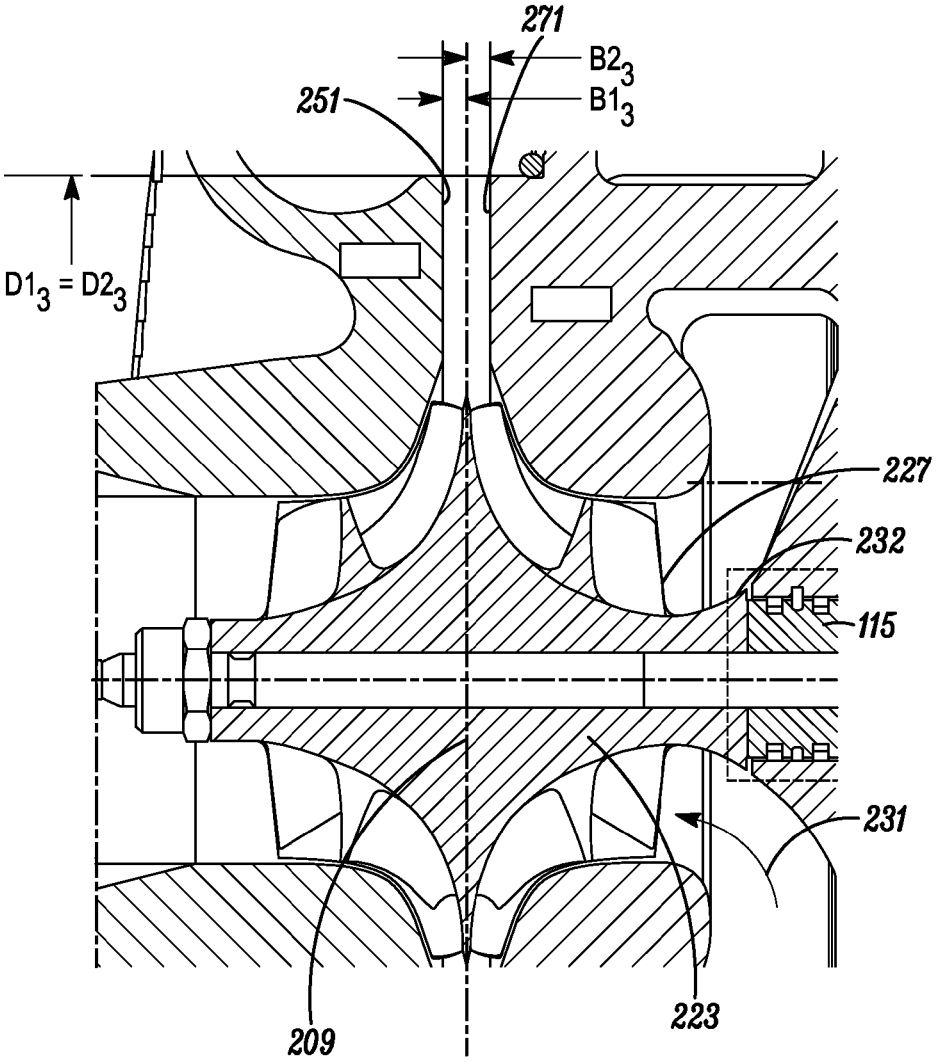
FIG. 5 is a cross-sectional view of a two-sided compressor in the embodiment of FIG. 2, including the two-sided compressor wheel depicted in FIG. 3.
Figure 6:
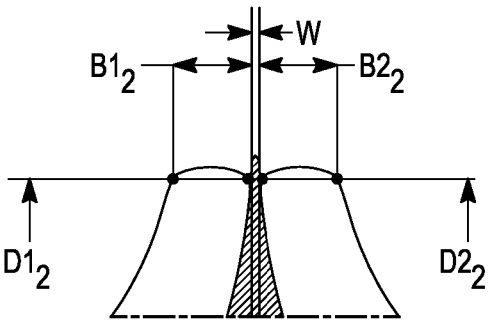
FIG. 6 is a cutaway view of a downstream end of compressor blades on the two-sided compressor wheel depicted in FIG. 3, as indicated by reference C on FIG. 4.

As is seen in FIGS. 4 and 6, $D1_{1,S}$ and $D2_{1,S}$ are the diameters of the shroud edge of the (path of the) respective sets (pluralities of) blades at their respective inducers (i.e., where the shroud edges meet the leading edges). $D1_2$ and $D2_2$ are the diameters of the respective sets (pluralities) of blades at the roots of their respective exducers (i.e., where the hub edges meet the trailing edges).

EI1 and EI2 may be calculated as follows:

$$EI1 = \frac{\text{wheel outlet annulus area, } E1}{\text{wheel inlet annulus area, } I1} = \frac{\mu D1_2 B1_2}{\frac{\pi(D1_{1,S}^2 - D1_{1,H}^2)}{4}}$$

$$EI2 = \frac{\text{wheel outlet annulus area, } E2}{\text{wheel inlet annulus area, } I2} = \frac{\mu D2_2 B2_2}{\frac{\pi(D2_{1,S}^2 - D2_{1,H}^2)}{4}}$$

As is seen in the figures, $D1_{1,H}$ and $D2_{1,H}$ are the diameters of the hub edges of the (path of the) respective sets (pluralities) of blades at their respective inducers (i.e., where the hub edges meet their respective leading edges), and $B1_2$ and $B2_2$ are the axial widths of the respective sets of blades at their respective exducers.

Diffuser

With reference to FIGS. 2-5, the diffuser forms a first side 251 surrounding the first plurality of blades 205 and a second side 271 surrounding the second plurality of blades 225. The first and second diffuser sides are divided by the backplate center-plane 210. The first side 251 is characterized by a first set of one or more parameters, which includes a first annulus area ratio (i.e., DE1). The second side 271 is characterized by a second set of one or more parameters, which includes a second annulus area ratio (i.e., DE2). Each annulus area ratio represents only the portion of the diffuser around a given set (plurality) of blades.

DE1 and DE2 may be calculated as follows:

$$DE1 = \frac{\text{diffuser outlet annulus area, } D1}{\text{wheel outlet annulus area, } E1} = \frac{D1_3 B1_3}{D1_2\left(B1_2 + e1 + \frac{1}{2}w\right)}$$

$$DE2 = \frac{\text{diffuser outlet annulus area, } D2}{\text{wheel outlet annulus area, } E2} = \frac{D2_3 B2_3}{D2_2\left(B2_2 + e2 + \frac{1}{2}w\right)}$$

As is seen in the figures, $D1_2$ and $D2_2$ are the diameters of the hub edges of the (path of the) respective sets (pluralities) of blades at their respective inducers (i.e., where the hub edges meet their respective leading edges), and $B1_2$ and $B2_2$ are the axial widths of the respective sets of blades at their respective exducers. As is seen in the figures, $D1_3$ and $D2_3$ are equal, and represent the diameter of a downstream end (outlet) of the diffuser (i.e., where the airstream in the diffuser passageway enters the volute). $B1_3$ and $B2_3$ are the final (e.g., downstream end) axial widths of the respective sides of the diffuser. Also, e1 and e2 are the respective axial distances between the respective shroud edges of the blades and the respective shrouds at the respective exducers (where each shroud edge meets its trailing edge. Finally, w is the width of the backplate 209 at the exducer. Thus, for each side, ($B_2$+e+½w) is the axial width of the passageway at the exducer plus half of the backplate width.

Functional Assymetry

Under the present invention, the blades may be functionally asymmetric, the diffuser may be functionally asymmetric, or both may be functionally asymmetric. This typically means that a first set of blade and diffuser parameters that represent the first set of blades and the first side of the diffuser (e.g., Trim1, EI1 and DE1) are not entirely identical to a second set of blade and diffuser parameters that represent the second set of blades and the second side of the diffuser (e.g., Trim2, EI2 and DE2). At least one of the parameters varies between the first and second set (i.e., between the two sides of the compressor wheel and diffuser).

For example, the value of DE1 might be different than the value of DE2, the value of EI1 might be different than the value of EI2, and the value of Trim1 might be different from the value of Trim2. As another example, the value of DE1 might be different than the value of DE2 and the value of EI1 might be different than the value of EI2, while the value of Trim1 might be the same as the value of Trim2. As a result of the sets of parameters being different from one another, the compressor wheel is an axially, functionally asymmetric compressor wheel.

In this embodiment, as compared to the values of the second set of parameters, the values of the first set of parameters is configured to produce greater airflow through the first wheel-side of the compressor wheel (as compared to the airflow through the second wheel-side). In this case, the value of the first trim is greater than the value of the second trim. Advantageously, this leads to a greater flux of air through the first wheel-side than through the second wheel-side of the compressor wheel. Because the first wheel-side is an external-inducer wheel-side, it will generally be more efficient because of the pressure loss of the flow heading into the second wheel-side. Thus the greater airflow (i.e., flux) is passed through the more efficient wheel-side. Additionally, initial surge events of the first wheel-side will not typically coincide with initial surge events of the second wheel-side, reducing the deleterious effects of a surge event.

Moreover, depending of the configuration of the turbine, the rotor bearings may experience axial loads from the turbine in either a toward-the-turbine loading direction or a toward the compressor loading direction. By using an asymmetric two-sided compressor blade configuration, i.e., a configuration where the first set of parameters differs from the second set of parameters, the compressor may be configured to provide axial loading in an opposite direction to the loading from the turbine wheel. As a result, over some range of high-loading operating conditions, lower total axial loads might be carried by the axial bearings, and thus the axial bearings might be designed to be smaller, lighter, and/or less expensive, and/or to provide less drag.

It should be noted that other types of functional asymmetry are within the broadest scope of the invention. For example, while it is preferred that the structural trim be varied, it is within the broadest scope of the invention for the aerodynamic trim to be varied even though the structural trim, annulus area and vaneless diffuser annulus area ratio are not varied. Likewise, a compressor wheel with blades having different profiles, different curvatures or different lengths on opposite sides of the wheel could be functionally asymmetric even though the structural trim, annulus area, vaneless diffuser annulus area ratio and aerodynamic trim are all the same. Moreover, differing hub shapes could also lead to functional asymmetry. As another example, different quantities of blades on opposite sides of the wheel would lead to a functional asymmetry.

Second Embodiment

Figure 3:
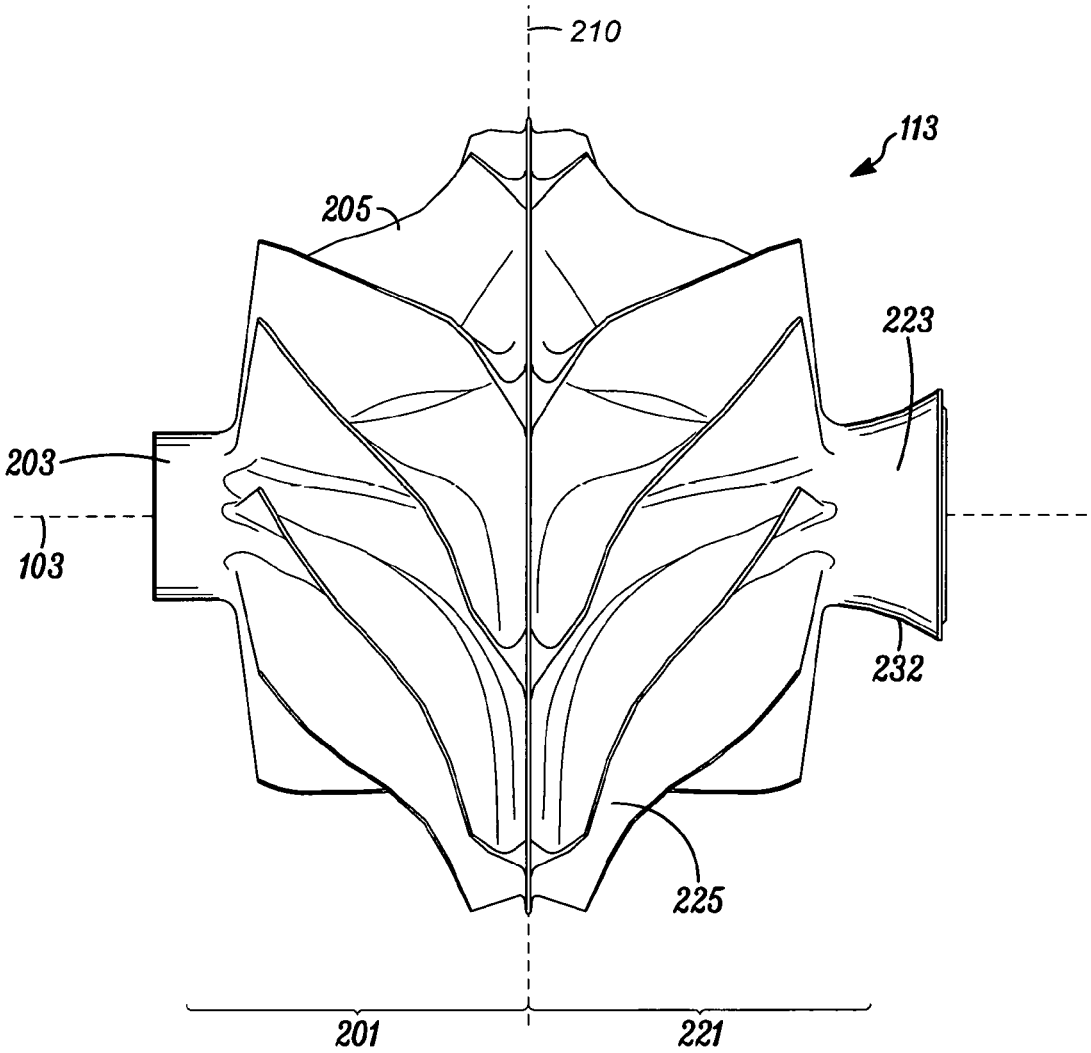
FIG. 3 is a plan view of a two-sided compressor wheel in the embodiment of FIG. 2.
Figure 7:
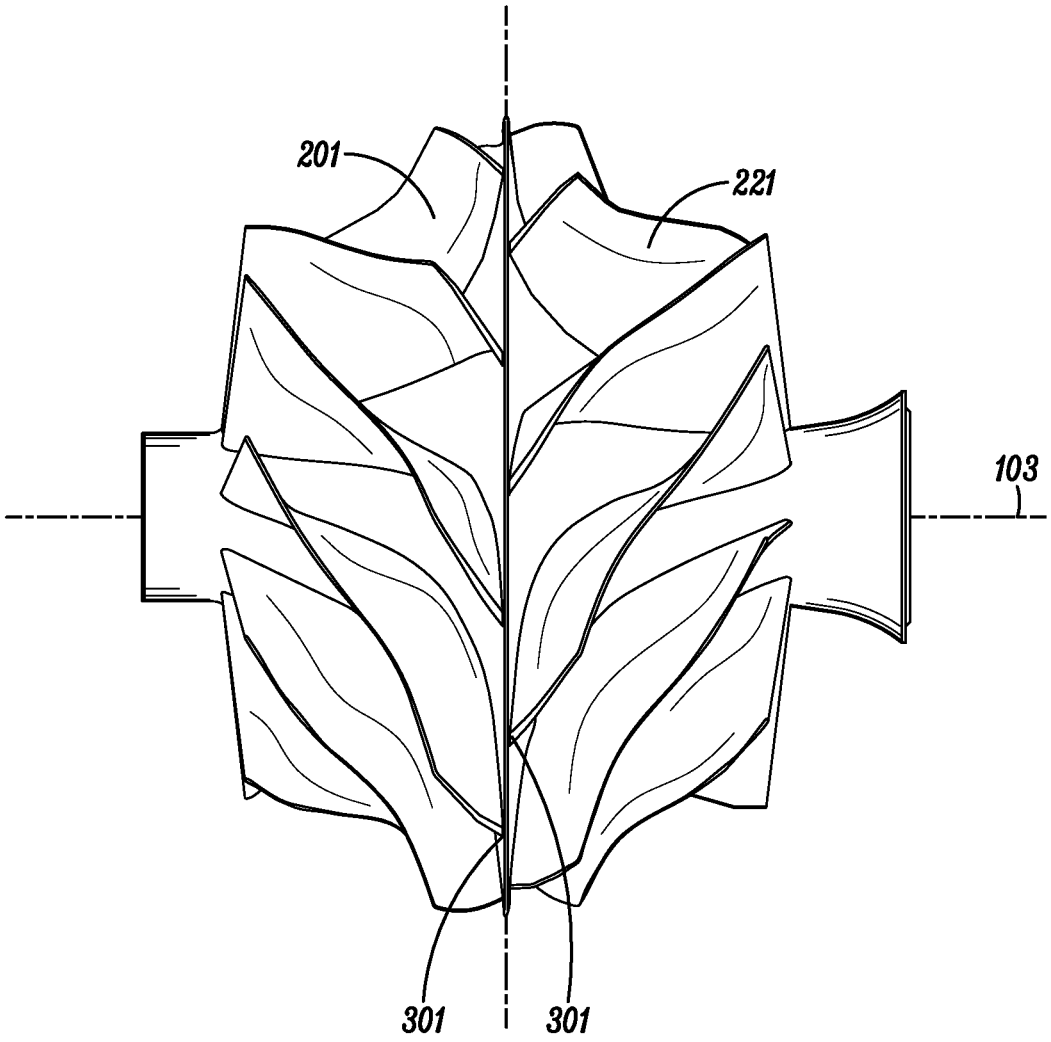
FIG. 7 is a plan view of a two-sided compressor wheel of a second embodiment of the invention.

With reference to FIG. 7, a second embodiment of the invention is structurally the same as the first embodiment, with one exception. Therefore like reference numbers are used. As depicted in FIG. 3, in the first embodiment the blades are depicted as aligned at the root edge of the exducer (where the blade hub edge intersects with the trailing edge).

In the second embodiment of the invention, the second wheel-side 221 is clocked with respect to the first wheel-side 201. For the purposed of this application, the term clocked is defined to mean that at least some, and possibly all, of the blades of the second wheel-side are at locations that are angularly offset around the axis of rotation 103 from all of the blades of the first wheel-side. More particularly, the root trailing edge 301 (i.e., the intersection of the hub edge and trailing edge) of some or all blades of the second wheel-side are at different circumferential locations than any of the root trailing edges 301 of the blades of the first wheel-sides.

Preferably, all of the blades of the second wheel-side are at locations that are angularly offset around the axis of rotation 103 from all of the blades of the first wheel-side. More particularly, the root trailing edge 301 (i.e., the intersection of the hub edge and trailing edge) of all blades of the second wheel-side are at different circumferential locations than the root trailing edges 301 of all of the blades of the first wheel-sides.

More preferably, each of the blades of the second wheel-side are at a location that is angularly offset around the axis of rotation 103 from the location of a corresponding blade of the first wheel-side by a singular angle (i.e., all of the second wheel-side blades are offset at the same angle from a corresponding blade of the first wheel-side). More particularly, the root trailing edge 301 of each of the blades of the second wheel-side are at a location that is angularly offset around the axis of rotation 103 from the location of a root trailing edge 301 of a corresponding blade of the first wheel-side by a singular angle (i.e., all of the second wheel-side blades are offset at the same angle from a corresponding blade of the first wheel-side).

Most preferably, as is depicted in FIG. 7, each of the blades of the second wheel-side are at a location that is angularly half way between (around the axis of rotation 103) two consecutive blades of the first wheel-side. More particularly, the root trailing edge 301 of each of the blades of the second wheel-side are at a location that is angularly half way between (around the axis of rotation 103) the root trailing edges 301 of two consecutive blades of the first wheel-side.

It is to be understood that the invention comprises apparatus and methods for designing and for producing a compressor wheel and housing, as well as the apparatus of the compressor wheel itself. Moreover, while this invention is described for a compressor, functionally asymmetric two-sided turbine wheels may also be within the scope of the invention. In short, the above disclosed features can be combined in a wide variety of configurations within the anticipated scope of the invention.

While particular forms of the invention have been illustrated and described, it will be apparent that various modifications can be made without departing from the spirit and scope of the invention. For example, a functionally asymmetric two-sided turbine wheel would be within the scope of the invention. Thus, although the invention has been described in detail with reference only to the preferred embodiments, those having ordinary skill in the art will appreciate that various modifications can be made without departing from the scope of the invention. Accordingly, the invention is not intended to be limited by the above discussion, and is defined with reference to the following claims.

What is claimed is:

1. A turbocharger, comprising:

turbocharger housing; and a rotor being mounted for axial rotation within the turbocharger housing, the rotor including a shaft extending axially between a turbine wheel and a two-sided compressor wheel, the two-sided compressor wheel having a plurality of blades including a first set of compressor blades surrounding a first hub portion at a first axial location, and a second set of compressor blades surrounding a second hub portion at a second axial location;

wherein the housing defines a diffuser for the compressor wheel, the diffuser including a first portion surrounding the first set of compressor blades, and the diffuser including a second portion surrounding the second set of compressor blades; and wherein the combination of the-first set of compressor blades and the diffuser first portion are functionally asymmetric with respect to the combination of the second set of compressor blades and the diffuser second portion.

2. The turbocharger of claim 1, wherein the diffuser first portion is functionally asymmetric with respect to the diffuser second portion.

3. The turbocharger of claim 1, wherein the first set of compressor blades are functionally asymmetric with respect to the second set of compressor blades.

4. The turbocharger of claim 1, wherein:

the first set of compressor blades are characterized by a first set of blade parameters consisting of a first wheel trim and a first annulus area;

the second set of compressor blades are characterized by a second set of blade parameters consisting of a second wheel trim and a second annulus area; and the values of the first set of blade parameters are not all identical to the values of the second set of blade parameters.

5. The turbocharger of claim 4, wherein the second trim is different than the first trim.

6. The turbocharger of claim 4, wherein the second annulus area is different than the first annulus area.

7. The turbocharger of claim 4, wherein the first trim is the structural trim of the first set of blades, and wherein the second trim is the structural trim of the second set of blades.

8. The turbocharger of claim 1, wherein:

the diffuser is characterized by a first annulus area ratio for the portion of the diffuser surrounding the first set of compressor blades, and by a second annulus area ratio for the portion of the diffuser surrounding the second set of compressor blades; and the first annulus area ratio is not identical to the second annulus area ratio.

9. The turbocharger of claim 1, wherein the combination of the plurality of blades and the diffuser are adapted to provide greater airflow through the first set of compressor blades than through the second set of compressor blades when provided with a given air pressure at inducers of the respective sets of compressor blades.

10. The turbocharger of claim 9, wherein the value of the first trim is greater than the value of the second trim.

11. A two-sided turbocharger wheel, comprising:

a hub defining an axial direction of wheel rotation; and a plurality of blades including a first set of blades on a first axial side of the hub and a second set of blades on a second axial side of the hub, the second axial side of the hub being an opposite axial side from the first axial side of the hub;

wherein the first set of compressor blades is functionally asymmetric with respect to the second set of compressor blades.

12. The two-sided turbocharger wheel of claim 11, wherein the first plurality of blades is characterized by a first trim, the second plurality of blades is characterized by a second trim, and the first trim is different than the second trim.

13. The two-sided turbocharger wheel of claim 12, wherein the first trim is the structural trim of the first plurality of blades, and wherein the second trim is the structural trim of the second plurality of blades.

14. The two-sided turbocharger wheel of claim 11, wherein the first plurality of blades is characterized by a first annulus area, the second plurality of blades is characterized by a second annulus area, and the first annulus area is different than the second annulus area.

15. The two-sided turbocharger wheel of claim 11, wherein the first plurality of blades is characterized by a first profile, the second plurality of blades is characterized by a second profile, and the first profile is different than the second profile.

16. The two-sided turbocharger wheel of claim 11, wherein the first plurality of blades is characterized by a first number of blades, the second plurality of blades is characterized by a second number of blades, and the first number of blades is different than the second number of blades.

17. A turbocharger rotor, comprising:

the two-sided turbocharger wheel of claim 11; a second turbocharger wheel; and a shaft extending between the two-sided turbocharger wheel and the second turbocharger wheel;

wherein the first plurality of blades is farther from the second turbocharger wheel; and wherein the first plurality of blades is configured for greater airflow than the second plurality of blades when provided with a given air pressure at inducers of the respective sets of compressor blades.

18. The turbocharger rotor of claim 17, wherein the first plurality of blades is characterized by a first trim, the second plurality of blades is characterized by a second trim, and the first trim is greater than the second trim.

19. The two-sided turbocharger wheel of claim 18, wherein the first trim is the structural trim of the first plurality of blades, and wherein the second trim is the structural trim of the second plurality of blades.

20. A turbocharger, comprising:

a turbocharger housing; the turbocharger rotor of claim 17; and a plurality of bearings rotatably mounting the turbocharger rotor within the turbocharger housing.

21. The turbocharger of claim 20, wherein:

the first plurality of blades is farther from the second turbocharger wheel; and the first plurality of blades is configured for greater airflow than the second plurality of blades when provided with a given air pressure at inducers of the respective sets of compressor blades.

* * * * *